United States Patent [19]

Ekman et al.

[11] 4,128,904

[45] Dec. 12, 1978

[54] BATH EQUIPMENT FOR DISABLED PERSONS

[75] Inventors: Lars Ekman, Helsingborg, Sweden; Helge Norman, Lagvagen 41, (Ytterby) Kungälv, Sweden, 442 00

[73] Assignee: Helge Norman, Kungälv, Sweden

[21] Appl. No.: 802,190

[22] Filed: May 31, 1977

[30] Foreign Application Priority Data

Feb. 26, 1976 [SE] Sweden ..... 7602439
Nov. 26, 1976 [SE] Sweden ..... 7613258

[51] Int. Cl.[2] ..... A47K 3/12
[52] U.S. Cl. ..... 4/185 L
[58] Field of Search ..... 4/185 L, 185 R, 134, 4/145, 185 S, 185 AB, 185 HB, 174, 173, 175, 176, 178; 5/63, 81 R, 83, 84, 85, 92

[56] References Cited

U.S. PATENT DOCUMENTS

| | | | |
|---|---|---|---|
| 2,494,224 | 1/1950 | Banson | 4/185 L |
| 2,680,855 | 6/1954 | Robinson | 4/185 L |
| 2,754,523 | 7/1956 | Brucknar et al. | 4/185 L |
| 3,091,778 | 6/1963 | Gross | 4/185 L |
| 3,268,918 | 8/1966 | Batty et al. | 4/185 L |
| 3,400,410 | 9/1968 | Sallingen | 4/185 L |
| 3,457,569 | 7/1969 | Ardenne et al. | 4/185 L |
| 3,624,666 | 11/1971 | Higgin, Sr. | 4/185 L |
| 3,889,304 | 6/1975 | Loran | 4/185 L |

*Primary Examiner*—Henry K. Artis
*Attorney, Agent, or Firm*—Holman & Stern

[57] ABSTRACT

A device is provided for the transfer of disabled persons into and out of a bath tub. The device comprises a bath plate, which is pivoted about at least one axis fixed to the bath tub. The bath plate can by means of a power unit, e.g. a hydraulic lifting cylinder, be lowered or lifted in the bath tub. The bath plate is divided into at least two parts, which are pivotally connected to each other.

8 Claims, 10 Drawing Figures

BATH EQUIPMENT FOR DISABLED PERSONS

BACKGROUND OF THE INVENTION

The present invention refers to a bath equipment for disabled persons and comprising means for lowering and lifting a bath plate in a bath tub by means of a power unit.

Devices of different kinds are previously known for the transfer of a disabled person into a bath tub. One device of this kind comprises a hydraulic lifting cylinder, the piston rod of which extends through the bottom of the bath tub and supports a bath plate at its free end. Such a device is very expensive and can therefore be used only in large-scale bath establishments in hospitals.

A device is also known, in which the person is placed on an endless stretched belt arranged across the bath tub, at which the person is lowered into the bath tub by lengthening the belt opposite the bath tub. Notwithstanding that this device is rather complicated, it can occur that the head of the person is immersed under water before the feet and legs, for which reason this device has not been used to any considerable extent.

Devices are also known, at which the person is lowered into the bath tub from above by means of a crane. Such devices require a lot of space and have a complicated construction and are difficult to handle.

SUMMARY OF THE INVENTION

The purpose of the invention is to provide a bath equipment for stationary bath tubs of conventional kind as well as for bath tubs with special lifting means, said equipment shall be simple to handle, shall require little or no space at all outside the bath tub and shall be considerably cheaper compared to the above mentioned lifting devices.

This is according to the invention achieved by that the bath plate is pivoted about at least one axis, which is fixed to the bath tub, and that a power unit is connected to the bath plate and is arranged to lower the bath plate from a substantially horizontal position above or level with the upper edge of the bath tub to a position at the bottom of the bath tub and vice versa.

DESCRIPTION OF SOME PREFERRED EMBODIMENTS

Figure 1:
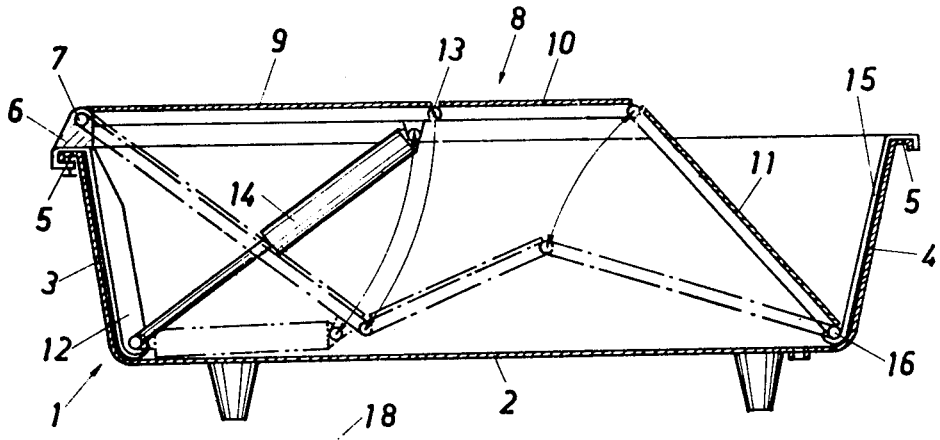
FIGS. 1–5 are longitudinal sections through different embodiments of bath equipments according to the invention applied to stationary bath tubs.

In the drawings a bath tub is denoted with the numeral 1, the bottom of the bath tub is denoted with the numeral 2 and the head end and foot end respectively of the tub with the numerals 3 and 4 respectively and the upper edge of the tub with the numeral 5. The bath equipment according to FIG. 1 comprises an attachment 6 arranged at the upper edge of the head end of the bath tub, said attachment is provided with bearings for a bath plate 8, which is pivoted about an axis 7. The bath plate 8 comprises three parts according to this embodiment, namely a support for the back 9, a support for the hips 10 and a support for the legs 11. The attachment 6 is provided with a support link 12, which extends to the bottom of the bath tub 1 at its head end 3. A hydraulic lifting cylinder 14 is pivotally attached to the end of the support link 12 remote from the attachment 6, the opposite end of the lifting cylinder is attached to the bath plate 8 close to the hinge 13 between the support for the back 9 and the support for the hips 10. A support link 15 is also arranged at the foot end 4 of the bath tub 1, said support link 15 is hook-shaped at the end situated close to the bottom 2 of the tub 1 for the reception of a link pin 16 arranged at the end of the support for the legs 11. The hinge 13 is so designed, that the support for the hips 10 can not be pivoted below the horizontal plane but can be hinged towards the support for the back 9.

The hydraulic lifting cylinder 14 is connected to a thrustwater service by a tube (not shown), so that the bath plate 8 can be pivoted from the position shown with dashdotted lines to the position shown with continuous lines.

Figure 2:
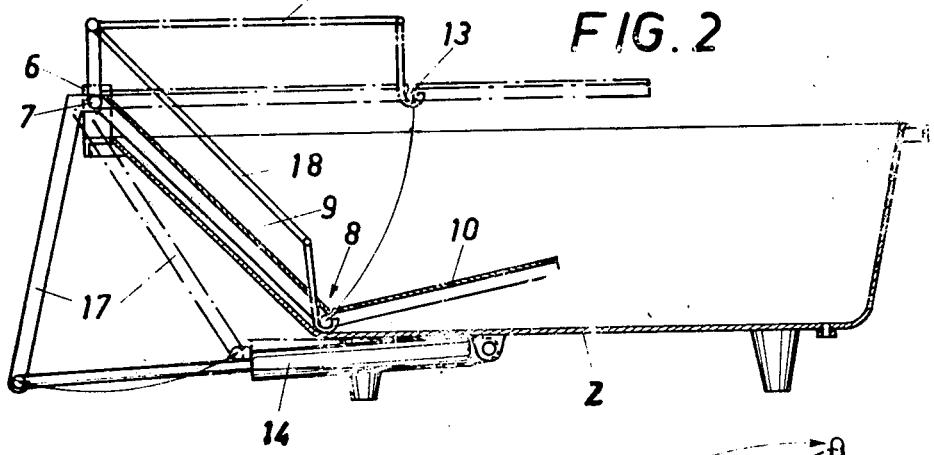

According to the embodiment of FIG. 2 the support for the back 9 is unrotatably connected to an arm 17 outside the bath tub 1, the free end of said arm 17 is connected to a hydraulic lifting cylinder 14, the opposite end of which is pivotally attached to the underside of the bath tub 1. The arm 17, which makes an angle with the support for the back 9, is journalled in the attachment 6 about the axis 7, so that the support for the back 9 can be pivoted from a subtantially horizontal position (indicated with dash dotted lines) to a position parallel with the head end 3 of the bath tub 1. By means of a parallel rod 18 the support for the hips 10 is kept in a substantially horizontal position during the pivoting movement of the support for the back 9.

Figure 3:
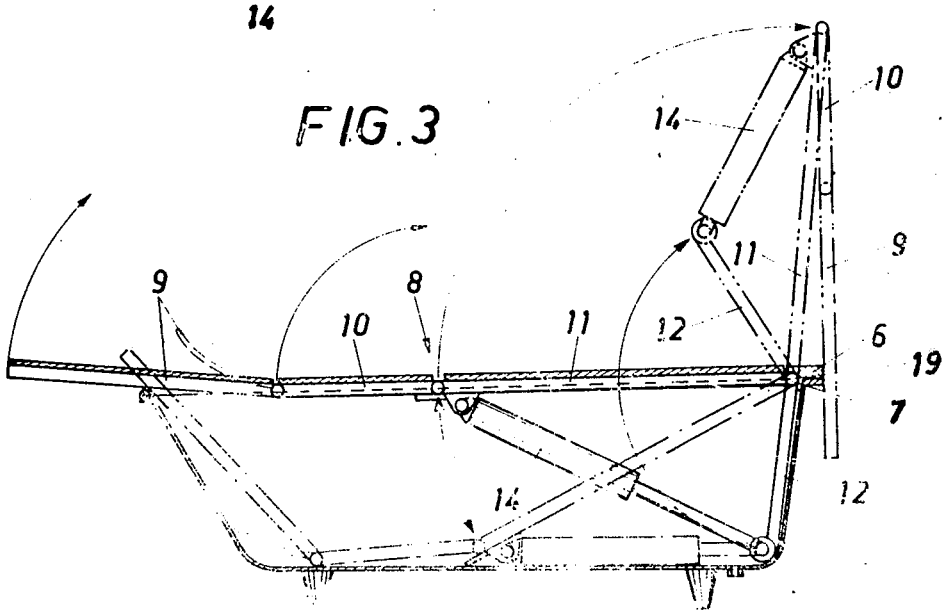

According to the embodiment of FIG. 3 the attachment 6 with the axis 7 and the support link 12 is attached to the foot end 4 of the bath tub 1, at which a link axis 19 is provided between the attachment 6 and the support link 12, said link axis is preferably arranged in the same axial line as the axis 7. The support for the back 9 rests on the upper edge of the head end 3, to which friction reducing means can be attached. The bath plate 8 is by means of the hydraulic lifting cylinder 14 pivoted down into the bath tub 1 to the position indicated with dash dotted lines from its substantially horizontal position, it can also be pivoted out of the bath tub 1 as is indicated with dash double-dotted lines, at which also the support link 12 is pivoted about the link axis 19 out of the bath tub 1.

Instead of supporting the support for the back 9 on the upper edge of the bath tub it can be of the shape as indicated with dashed lines and in this case it is fixed to the support for the hips 10.

Figure 4:
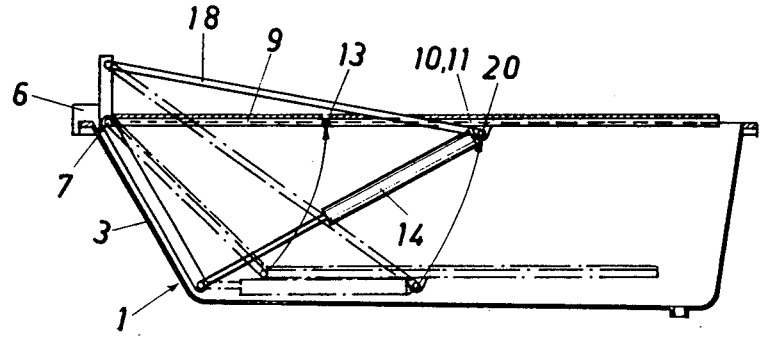

The embodiment according to FIG. 4 differs from the one according to FIG. 1 by that, that the pivotal point of action of the hydraulic lifting cylinder 14 is not situated close to the hinge axle 13, but at a distance from this at the combined support for the hips and legs 10, 11. Said support is kept in a horizontal position by a parallel bar 18.

Figure 5:
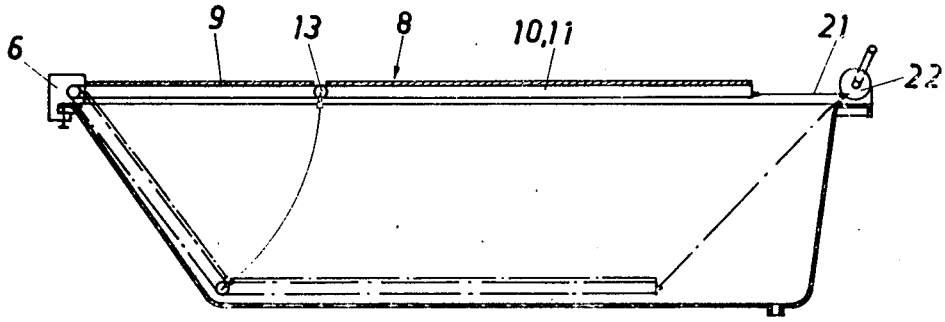

In FIG. 5 the simplest embodiment of the bath equipment according to the invention is shown. The support for the back 9 of the bath plate 8 is pivotally mounted in the attachment 6 at the head end 3 of the bath tub 1, while the end of the combined support for the hips and legs 10, 11 facing the foot end 4 of the bath tub 1 is connected to a power unit by at least one wire 21, said power unit according to this embodiment consists of a hand-operated hoist 22. Of course other power units can be used, e.g. electromotive hoistes.

Figure 6:
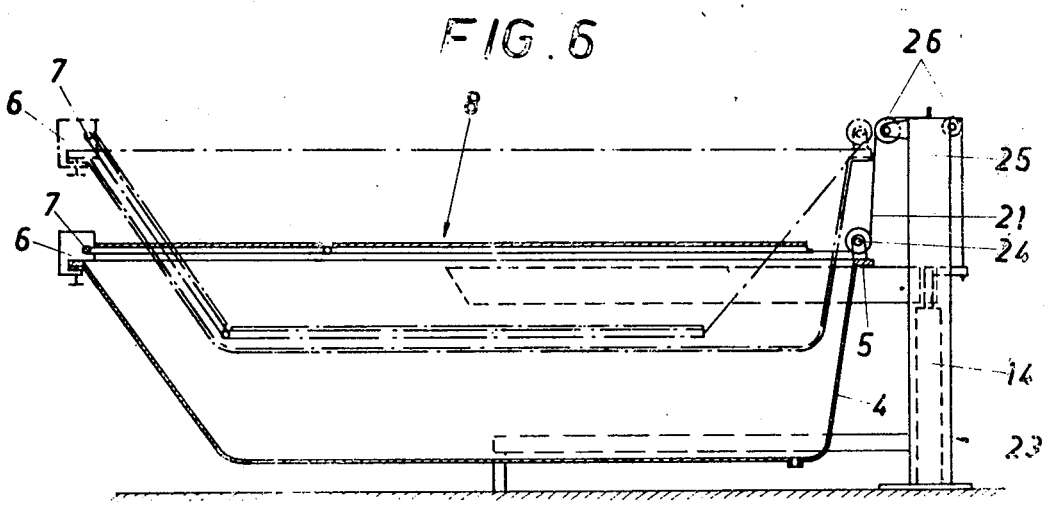
FIGS. 6 and 7 are longitudinal sections through two other embodiments for vertically adjustable bath tubs.

In FIG. 6 the embodiment according to FIG. 5 is shown for a bath tub provided with a lifting device, by means of which the bath tub 1 can be lifted from a lower position, in which the person can be transferred into the bath tub, to an upper position, which corresponds to a correct working level for the nursing staff. In this embodiment the wire 21 is guided by a roller 24 secured at the upper edge 5 of the foot end 4 and by two rollers 26 arranged at the housing 25 and is connected to the upper end of the piston rod of the hydraulic lifting cylinder 14.

When lifting the bath tub 1 by means of the lifting cylinder 14 the wire 21 is slackened, and the bath plate 8 is lowered to the position indicated by dash dotted lines.

Figure 7:
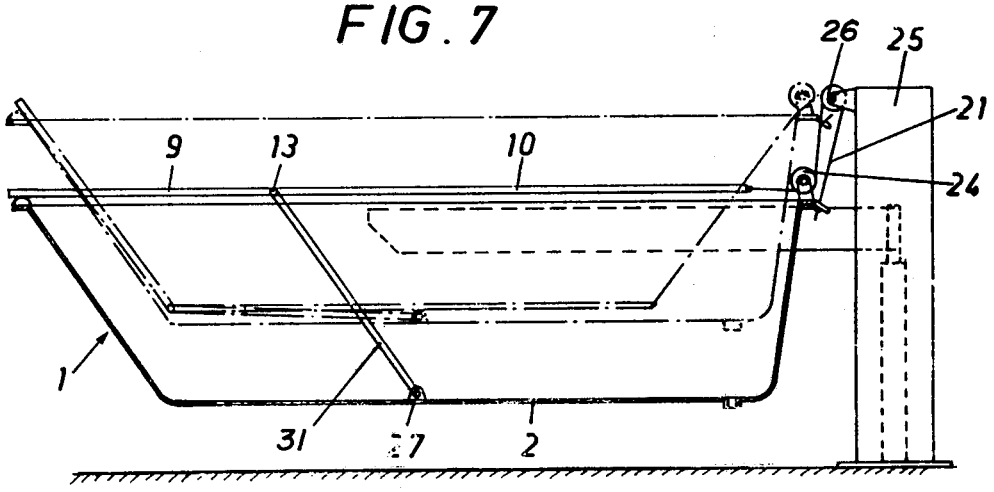
Figure 8:
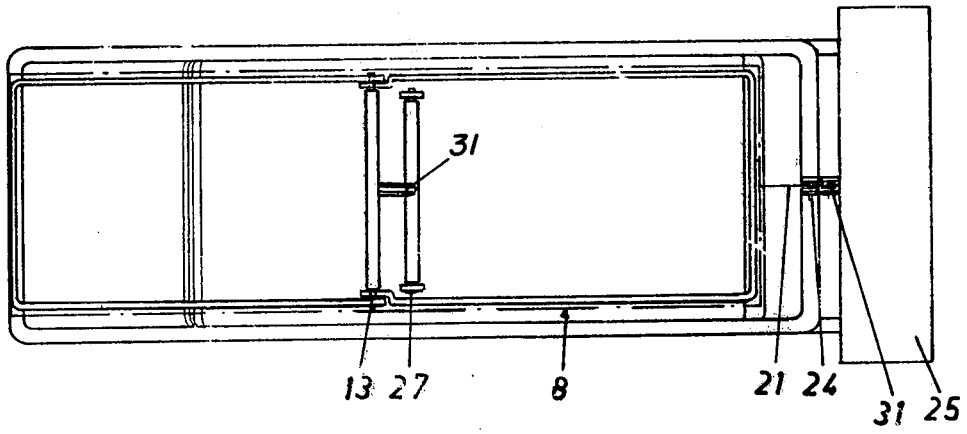
FIG. 8 is a plane view of the bath equipment according to FIG. 7, FIGS. 9 and 10 show a somewhat modified embodiment in two different positions.

The embodiment according to FIGS. 7 and 8 is a modification of the embodiment according to FIG. 6, at which the fixed attachment 6 with the pivot axis 7 for the bath plate 8 is not necessary, and is replaced by a standard 31. The standard 31 is at its upper end hingedly connected to the hinge 13 between the support for the back 9 and the support for the hips 10, while its opposite end is pivotally mounted at the bottom 2 of the bath tub 1. The journals 27 for the standard 31 can either be secured to the bottom of the bath tub or e.g. cling to said bottom by means of suction members.

The actuation of the bath plate 8 is done in a similar way as according to the embodiment of FIG. 6, but the wire 21 is according to the embodiment of FIGS. 7 and 8 not connected to the piston rod of the lifting cylinder 14, but is lead over the rollers 24 and 26 and back to the upper edge of the bath tub 1, to which the wire 21 is fixed. When lifting the bath tub the wire 21 is slackened so that the standard 31 is pivoted towards the bottom of the bath tub 1 and takes the position indicated with dash dotted lines. When lowering the bath tub the wire 21 is stretched and the bath plate 8 is pivoted back to its horizontal position. At this pivoting movement of the bath plate 8 the support for the back 9 is supported against the upper edge 5 of the bath tub 1.

Figure 9:
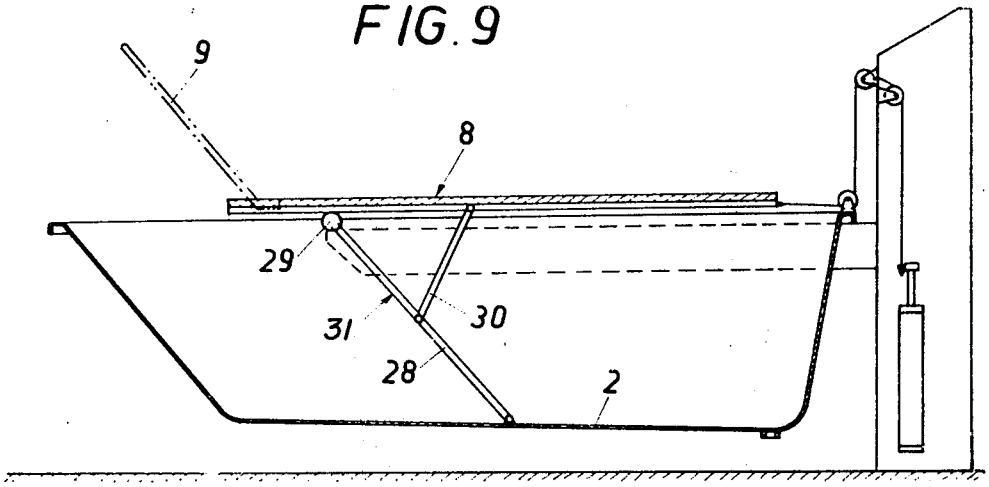
Figure 10:
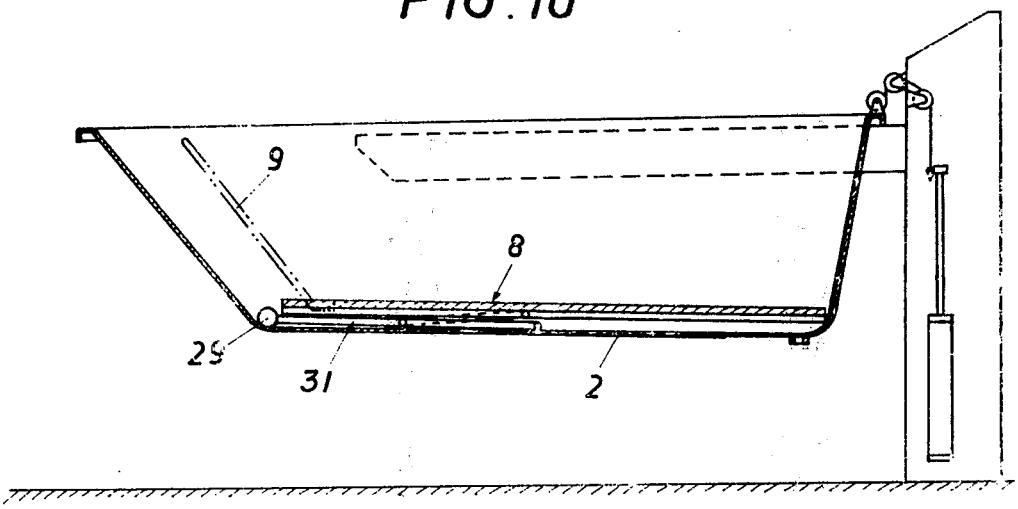

The embodiment according to FIGS. 9 and 10 is a further developement of the bath equipment shown in FIGS. 7 and 8, at which the bath plate 8 can be in one piece. The standard 31 comprises a first link 28 being pivotally connected to the bottom 2 of the bath tub 1 and at its opposite end being provided with friction reducing means 29 as rollers or runners, which contact the underside of the bath plate 8. A strut 30 is pivotally connected to the link 28 at about the middle of said link 28, the opposite end of said strut 30 being pivotally connected to the underside of the bath plate 8.

When lowering the bath plate 8 the link 28 is pivoted against clockwise direction towards the bottom 2 of the bath tub 1, while the strut 30 makes a pivoting movement in clockwise direction, at which the link 28 and the strut 30 are lowered to the position at the bottom 2 of the bath tub 1 shown in FIG. 10.

The bath plate 8 can be provided with a pivoted or fixed support for the back, which is indicated with dash dotted lines.

The invention is not limited to the embodiments shown, but can be varied within the scope of the claims. Thus details from the different embodiments can be exhanged and e.g. the power unit of FIG. 1 can be replaced by the power unit of FIG. 5, at which the wire 21 preferably is attached to the joint between the support for the hips 10 and the support for the legs 11. It is of course also possible to connect the lifting cylinder 14 to a fixed bearing at the bottom of the bath tub instead of to a support link.

The bath equipments shown are all so constructed, that at least a part of the bath plate can be folded so that the bath tub and the bath equipment can be cleaned after a bath.

What I claim is:

1. In combination a bath tub and a device for lowering a patient into and lifting a patient out of said bath tub, said device comprising a bath plate having two ends, one of said ends being pivotally fixed to one end of said bath tub; a wire secured to the opposite end of said bath plate; and means for tensioning and slackening said wire operatively connected to said wire whereby said bath plate can be lowered in and lifted out of said bath tub.

2. In combination a bath tub having a rim and a bottom and a device for lowering a patient into and lifting a patient out of said bath tub, said bath tub including means for lifting and lowering the same operatively associated therewith, said device comprising a bath plate having two ends and an underside; means for pivotally connecting said bath plate to said bath tub secured to said bath tub; a fixed length wire secured between one end of said bath plate and a point of attachment; and guide means interposed between said one end of said bath plate where said wire is secured and said point of attachment for guiding said wire whereby as said bath tub is moved by said means for lifting and lowering the same, said wire moves through said guide means simultaneously moving said bath plate in the opposite direction.

3. The combination according to either claim 1 or 2, wherein said bath plate longitudinally comprises at least two portions and plate hinge means, said hinge means pivotally joining at least two portions, one of said portions forming a support for the back of the patient and the other forming a support for the hips and legs.

4. The combination according to claim 2 wherein said means for pivotally connecting said bath plate to said bath tub comprises hinge means secured to the rim of said bath tub and the end of said bath plate opposite from the end to which said wire is secured.

5. The combination according to claim 2, wherein said bath plate longitudinally comprises at least two portions and plate hinge means, said hinge means pivotally joining at least two portions, one of said portions forming a support for the back of the patient and the other forming a support for the hips and legs, and said means for pivotally connecting said bath plate to said bath tub comprises a standard having two ends, one of said ends being hingedly connected to said bottom of said bath tub and the other being pivotally connected to said bath plate proximate to said plate hinge means.

6. The combination according to claim 3, wherein said means for pivotally connecting said bath plate to said bath tub comprises a standard having two ends and a middle, one of the ends being hingedly connected to said bottom of said bath tub; a friction reducing means connected to the other end of said standard contacting said underside of said bath plate; and a strut having opposite ends, one of said opposite ends of said strut being pivotally connected to said middle portion of said standard and the other being pivotally connected to said bath plate.

7. The combination according to claim 2, wherein said point of attachment is on the rim of said bath tub.

8. The combination according to claim 3 wherein said point of attachment is on said means for lifting and lowering said bath tub.

* * * * *